US005722431A

United States Patent [19]

Metzner et al.

[11] Patent Number: 5,722,431

[45] Date of Patent: Mar. 3, 1998

[54] METHOD AND PLANT FOR TREATING TOBACCO LEAVES FOR THE PRODUCTION OF CUT TOBACCO

[75] Inventors: Wolfgang Metzner, Hamburg; Bernd Spallek, Syke; Arno Weiss, Norderstedt, all of Germany

[73] Assignee: British-American Tobacco, Hamburg, Germany

[21] Appl. No.: 751,481

[22] Filed: Nov. 18, 1996

[30] Foreign Application Priority Data

Nov. 20, 1995 [DE] Germany ..... 195 43 262.2
Sep. 26, 1996 [EP] European Pat. Off. ..... 96115458

[51] Int. Cl.[6] ..... A24B 5/00

[52] U.S. Cl. ..... 131/290; 131/311

[58] Field of Search ..... 131/311–317, 290, 131/324, 903

[56] References Cited

U.S. PATENT DOCUMENTS

| | | | |
|---|---|---|---|
| 3,219,042 | 11/1965 | Molins | 131/290 |
| 3,556,112 | 1/1971 | Zygmunt et al. | 131/140 |
| 4,233,996 | 11/1980 | Brackmann et al. | 131/140 |
| 4,366,823 | 1/1983 | Rainer et al. | 131/291 |
| 4,449,540 | 5/1984 | Marshall | 131/290 |
| 4,696,312 | 9/1987 | Turano et al. | 131/109.1 |

FOREIGN PATENT DOCUMENTS

| | | |
|---|---|---|
| WO 94/10846 | 5/1994 | European Pat. Off. . |
| 2 336 093 | 7/1977 | France . |
| 1 432 585 | 11/1968 | Germany . |
| 2731871 | 1/1978 | Germany . |
| 2921025 | 11/1979 | Germany . |
| 29 13 823 | 10/1980 | Germany . |
| 40 29 566 A1 | 3/1991 | Germany . |
| 40 29 567 A1 | 3/1991 | Germany . |
| 695527 | 10/1979 | U.S.S.R. . |
| 2 026 298 | 2/1980 | United Kingdom . |
| 2118817 | 11/1983 | United Kingdom . |
| 2131671 | 6/1984 | United Kingdom . |

OTHER PUBLICATIONS

Voges, Ernst; *Tobacco Encyclopedia*; 1984; pp. 414–421.

Eurasian Patent Office Comm. for Eurasian Ap.# EA–96–0098–DE/26 dated Jul. 16, 1997.

*Primary Examiner*—Vincent Millin
*Assistant Examiner*—Charles W. Anderson
*Attorney, Agent, or Firm*—Armstrong, Westerman, Hattori, McLeland & Naughton

[57] ABSTRACT

The invention relates to a method and a plant for the treatment of tobacco leaves for the production of cut tobacco for smokable articles, in which stems or winnowings, on the one hand, and the lamina material of the tobacco leaves, on the other, are conditioned separately from each other. The conditioned, non-rolled stems are precut and the conditioned winnowings are rolled and individually respectively or also jointly blended with the conditioned and uncut lamina material; the resulting blend is then cut and dried.

25 Claims, 4 Drawing Sheets

METHOD AND PLANT FOR TREATING TOBACCO LEAVES FOR THE PRODUCTION OF CUT TOBACCO

BACKGROUND OF THE INVENTION

1. Field of the Invention

The invention relates to a method and a plant for treating tobacco leaves for the production of cut tobacco for smokable articles.

2. Description of the Prior Art

Tobacco leaves, from which smokable articles, particularly cigarettes as well as fine-cut for self-produced cigarettes, are obtained, consist of lamina and stems which, on the one hand, greatly differ in consistency and, on the other, greatly differ in taste perception and thus influence both the technique in preparing the tobacco and the taste perception of the respective smokable article to a very great extent, albeit differingly.

To get round the problems associated with the treatment of stems and the effects in taste caused by the stems, it is thus usual to separate the stems from the lamina and to use only the lamina for the production of cigarettes. Due to the percentage of stems in the overall weight of the tobacco leaves making up to roughly 30% by weight, this method represents, however, a very costly waste of the valuable "tobacco leaf" raw material.

This is why it has already been attempted to process whole tobacco leaves by specific methods of size reduction employing shear forces into a flowable blend of lamina particles and stem particles which may be put to use directly in cigarette production. This method, described for example in DE 40 29 566 A1, has, however, never been put into practice, since the taste properties failed to come up to expectations.

A mixed solution is disclosed by DE 40 29 567 A1 in which whole leaves are processed into a blend of lamina particles and substantially intact stem pieces in a method of size reduction employing shear forces; the stem pieces need to be subsequently separated out, the lamina particles then being directly supplied to cigarette production. Transferring this method into actual practice also failed due to the taste problems still waiting to be solved.

A further method is disclosed by GB 2,026,298 A in which tobacco leaves are reduced in size to particles which are suitable for cigarette production. By means of an air separating method the leaf particles are fractionated into a more heavy fraction containing the stems and a lighter lamina fraction free of stems, the heavier fraction being threshed, so as, in this case too, to still separate the lamina from the stems. The separated lamina and the lighter fraction originally obtained are then blended to be supplied to cigarette production. This method is highly complicated, the same also applying to the similar method according to U.S. Pat. No. 4,696,312.

It is thus still the usual practice to disintegrate the tobacco leaves into stems, on the one hand, and lamina, on the other, which is usually done in the country of origin shortly after harvesting. Stems and lamina are packaged separate from each other and shipped to the place of deployment where the so-called "primary tobacco preparation" is done. In this tobacco preparation the stems, on the one hand, and the lamina, on the other, are treated separately from each other, namely conditioned, i.e. subjected to moisture and heat treatment, cut and dried, before being finally blended and then subjected jointly to further processing, as a rule involving the addition of flavoring materials.

The basic principles of this method, by which both fine-cut and also cigarettes can be produced are described in the book "Tobacco Encylopedia" published by Ernst Voges, 1984, in the article "Cigarette Manufacture I and II", more particularly under the heading "The Production of Cut Tobacco".

The drawback in this generally used method is that in the primary tobacco preparation the stems, on the one hand, and lamina material, on the other, need to be run on processing lines totally separated from each other, in the so-called "stem line" and the so-called "lamina line", each of which comprise conditioning means, cutting means, saucing means for applying casings, heating means and driers. On the stem line rolls are also needed for the purpose of rolling out the stems prior to the cutting procedure to generate the "CRS", i.e. the cut and rolled stem pieces which are then added to the lamina material directly upstream of the flavor drum.

Both the costs of the investments for these two separate lines and the costs involved in running these two lines are high.

A similar problem as in processing tobacco stems is encountered in the case of the so-called "winnowings". These are tobacco particles, mainly again tobacco stems and ribs resulting during tobacco preparation and materializing from the cut tobacco material, prior to the cut tobacco being formed in the cigarette machine into a continuous rod of tobacco.

These winnowings consist also of tobacco, so that attempts should be made to make use of it for cigarette production.

A variety of methods are known for processing winnowings, for instance, the processing into reconstituted tobacco or recycling. The material obtained by these means is added to the normal cut tobacco during the primary tobacco preparation.

All of these methods are complicated and a nuisance, thus causing better solutions to be sought for all the time to re-introduce winnowings into tobacco preparation.

SUMMARY OF THE INVENTION

The invention is thus based on the object of providing a method and a plant for the treatment of tobacco leaves for the production of cut tobacco for smokable articles in which the aforementioned drawbacks are not encountered.

In particular it is intended to propose a method and a plant which permit the production of cut tobacco which are simple and thus both as regards the costs of investment and regarding the operating costs are more cost-effective whilst including tobacco stems and/or winnowings, permitting processing into either cigarettes, cigarillos or cigars or fine-cut.

This object is achieved for the stem material by a method of treating tobacco leaves for the production of cut tobacco for smokable articles, wherein non-rolled stems are conditioned and precut separately from the lamina material, lamina material is conditioned separately from the stems, stems and lamina material are subsequently blended and then lamina material and stems are cut and dried jointly, and by a plant for the treatment of tobacco leaves for the production of cut tobacco for smokable articles, comprising a conditioning means for the stems of the tobacco leaves separated from the lamina material, a conditioning means for the lamina material of the tobacco leaves, a precutting means for the stems, a cutting means for a blend of said conditioned, non-rolled, precut stems and said conditioned and uncut lamina material, and at least one drier for said cut blend of lamina material and stems. As to winnowing, this object is achieved by a method of treating tobacco leaves for the production of cut tobacco for smokable articles, wherein winnowings are conditioned and rolled separately from said lamina material, lamina material is conditioned separately from said winnowings, the rolled winnowings and said lamina material are subsequently blended, and lamina material and winnowings are cut and dried jointly, and by a plant for the treatment of tobacco leaves for the production of cut tobacco for smokable articles, comprising a conditioning means for winnowings, a rolling means for said conditioned winnowings, a conditioning means for the lamina material of said tobacco leaves, a cutting means for a blend of said conditioned, rolled winnowings and said conditioned and uncut lamina material, and at least one drier for said cut blend of lamina material and winnowings.

Advantageous forms of embodiments of these methods or plants are set forth in the corresponding sub-claims.

As regards the processing of stems, the advantages achieved by the invention are based on the fact that only a relatively small proportion of the "stem line" employed hitherto, namely a short stem line including a conditioning means and a stem precutter, are employed, whilst the rolls, the moisturizing and the heating means as well as the drier for the stems can be eliminated. The savings made possible thereby both as regards investments and operating costs, particularly as regards personnel, are considerable.

In addition, the measures claimed permit homogenous blending of lamina and stem material so that a highly consistent taste perception materializes.

Furthermore, the degree to which use is made of the raw tobacco is higher since due to the pronounced shortening in the length of the stem line much less dust materializes, i.e. the valuable "tobacco leaf" raw material is made use of very much more effectively. This is also contributed to by the fact that no drier is needed in the short stem line which, as is known from experience, contributes towards tobacco degradation.

At the same time, yet a further cost-saving feature is involved, since it is usually the case that winnowings and dust are collected, conditioned and returned to tobacco preparation. These steps can be eliminated due to the extremely minor amount of winnowings and dust occurring on the short stem line.

It is usually such that the tobacco stems and/or the lamina are provided with a casing. Although the corresponding saucing means, in principle, may be arranged at any suitable location in tobacco preparation and both the stem and the lamina material can be provided with a casing, it has turned out to be particularly expedient when only the lamina is treated this way. The casing is then done preferably after lamina conditioning by means of a saucing means.

It has been found out to be expedient when the stems prior to precutting are conditioned to a moisture content of approximately 22% to approximately 26%, particularly approximately 24%. These values apply to the % by weight moisture on a wet basis. The method of determining moisture is oven drying for 3 hours at 80° C. The moisture values according to the invention represent, as compared to a stem moisture content of approximately 30%, as cited in the "Tobacco Encyclopedia", a substantial improvement, since, on the one hand, the relative high moisturization is problematic and, on the other, the moisturizing necessary in this case also reduces the expense of later drying. In addition to this, stems premoisturized merely relatively slightly may be left standing longer without their properties changing to any remarkable degree, whilst the storage time for stems having a moisture content of approximately 30% is greatly restricted.

It has been found out to be expedient when, before precutting, the conditioned stems are held covered, i.e. in a closed environment, for at least 1.5 hours, particularly approximately 2 hours, to ensure a consistent moisturization.

The stems may be additionally provided with a casing. This may be done either prior to stem conditioning or after leaving the cutter by a saucing means.

The stems are precut to a cutting width of approximately 0.1 to approximately 0.3 mm, particularly approximately 0.2 mm.

If necessary—in modern cigarettes expanded tobaccos which take up a greater volume per unit of weight are finding increasing application for reasons of reducing costs—the stems should be expanded. This is done expediently after cutting the stems, an expansion device being employed as is known, for example, from German patent no. 37 10 677.

Whilst the short stem line according to the invention works substantially with the same values both for cigarettes and for fine-cut, a distinction needs to be made between fine-cut and cigarettes as regards conditioning the lamina. Thus, for cigarette production the lamina is conditioned to a moisture content of approximately 17 to approximately 25%, particularly ca. 17.5%, whilst for fine-cut production the lamina is conditioned to a moisture content of approximately 23 to approximately 25%, particularly approximately 24%.

The blending ratio between lamina and cut stems may be varied, depending on the requirements on the smokable article to be produced. Thus, lower priced product variants receive a higher stem percentage, for instance. For branded cigarettes the stem percentage of 30%, relative to the mass a whole, is not exceeded usually, it being in particularly in the range of approximately 5% to 25%.

Again, in cutting the blend of lamina and stems a distinction needs to be made between fine-cut production and cigarette production. In cigarette production the blend needs to be cut with a cutting width of approximately 0.5 to 2 mm, particularly approximately 0.85 mm, whilst in fine-cut production the cutting width should lie in the range of approximately 0.35 mm to approximately 0.5 mm, particularly approximately 0.45 mm.

After being cut jointly the blend of stem and lamina materials is heated and moisturized, preferably in a so-called preheat drum, operating with water and steam, to achieve a moisture content in the range of approximately 18 to 39%, particularly approximately 19.5 to approximately 24%, preferably approximately 22.5%.

Subsequently, the blend is dried, expediently in a hot-air drier which brings the moisture content of the blend to approximately 14%.

This is followed by the usual further processing of the material, depending on its intended application, i.e. cigarette production or fine-cut production.

As regards winnowings processing the advantages achieved by the invention are based on producing a tobacco material by a simple process, namely by conditioning and subsquently rolling the winnowings, which can be blended with the lamina without necessitating any further processing step before being cut and dried. In this way, the valuable "winnowings" raw material is fed to tobacco processing at little expense as regards investments and operating costs.

In accordance with an expedient embodiment the conditioned winnowings are rolled as flat as possible, i.e. with a "gap width" or "nip" of less than 0.1 mm, particularly with a nip of approximately 0 mm, so that small, flat pieces of tobacco materialize which can be blended with the lamina with no problem.

Expediently the rolled winnowings have a moisture content of approximately 25% to approximately 40%, particularly approximately 30 to approximately 35%.

Also possible is a combination of these processing methods, i.e. in a primary tobacco preparation plant three parallel lines may be installed, namely a lamina line, a stem line and a winnowings line. The three different materials obtained thereby are then blended in a blending bin and jointly cut before being fed to further processing.

BRIEF DESCRIPTION OF THE DRAWINGS

The invention will now be explained in detail on the basis of embodiments with reference to the attached schematic drawings in which.

DESCRIPTION OF THE PREFERRED EMBODIMENTS

Figure 1:
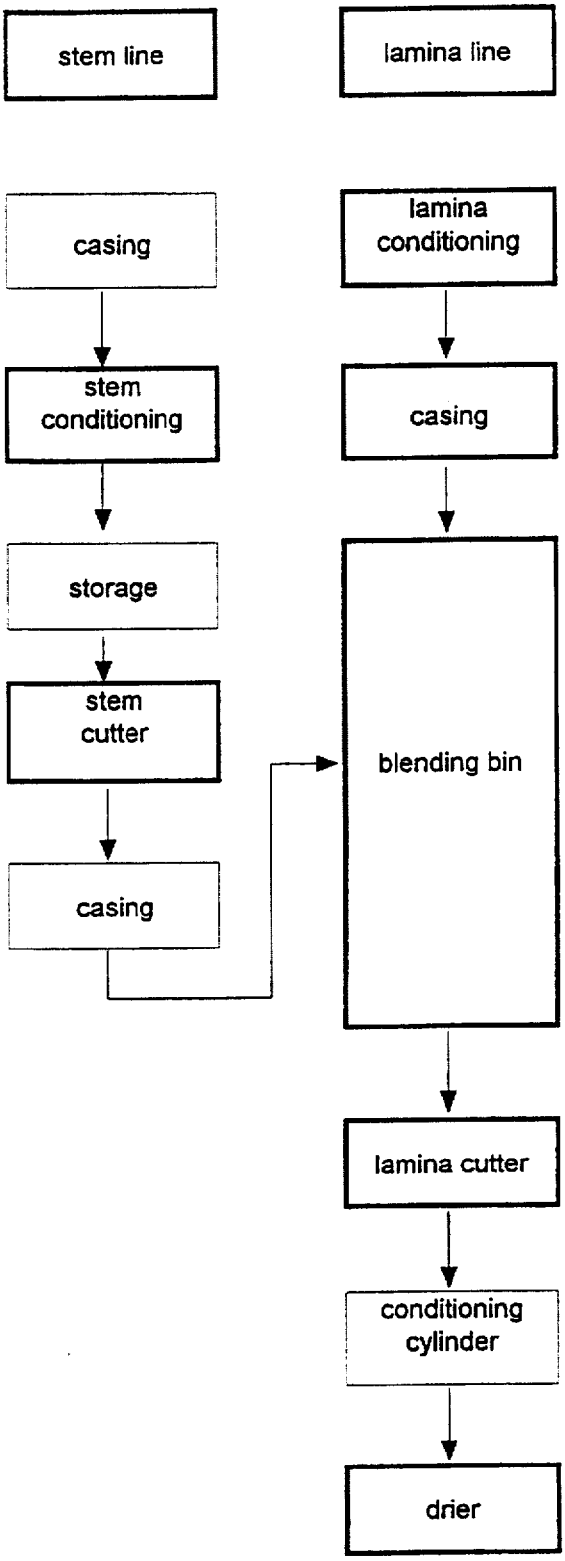
FIG. 1 shows a first embodiment of a plant for producing cut tobacco for cigarettes from stems and lamina material.

The plant shown in FIG. 1 processes stems, on the one hand, and lamina, on the other, which have been separated from each other in a prior stage (not shown), often in the country of origin of the tobacco leaves, and are now to be fed to the stem line, on the one hand, and the lamina line, on the other. In this arrangement the optional devices are indicated by dotted boxes.

The stems reach a saucing means in which they are provided with casings before entering a steam tunnel serving as a conditioning means which operates with water and steam so that the stems leave the conditioning with a moisture content of approximately 24%.

The conditioned stems are held covered for roughly 2 hours and are then fed to a stem precutter. The preferred cutting width is about 0.2 mm.

The precut stems are, where necessary, provided again with a casing, only one of the two saucing means being needed as a rule.

The precut stems are then fed to a charging chute leading to a blending bin to which also preconditioned lamina material is supplied. Provided upstream of this blending bin is a steam drum for the lamina material as a conditioning means in which the lamina material for cigarette production receives a moisture content of approximately 17.5% and lamina material for fine-cut production receives a moisture content of approximately 24%.

Between the conditioning means and the blending bin a saucing means is provided for the lamina material.

The proportion of stems in the blend in the blending bin is of the order of approximately 14% stem content relative to the blend as a whole.

The blend of stems and lamina material from the blending bin is cut with a cutting width of approximately 0.85 mm for the production of cigarettes and a cutting width of approximately 0.45 mm for fine-cut production, there being practically no change in the moisture content of the blend.

The cut blend of lamina material and stems reaches a conditioning or preheating cylinder where it is moisturized with water and steam and heated so that it leaves the conditioning cylinder with a moisture content of approximately 22%.

Subsequently, this blend is dried in a hot-air drier from which it emerges with a moisture content of approximately 14.5% and is then forwarded to the further steps of the primary tobacco preparation, for example a cooling and sieve drum as well as a flavor drum.

Figure 2:
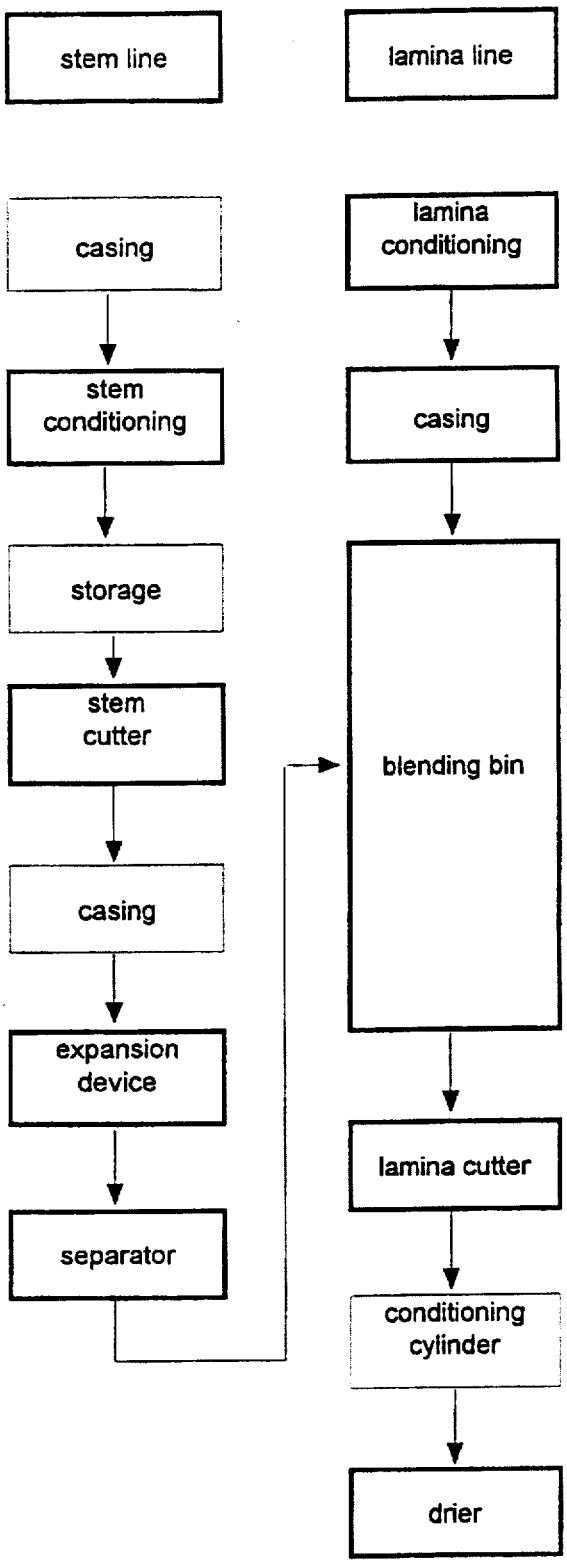
FIG. 2 shows a somewhat modified embodiment of the plant shown in FIG. 1.

The modified embodiment shown in FIG. 2 differs from the embodiment shown in FIG. 1 merely by the conditioned, non-rolled and cut stems being further subjected to an expansion method, as is known, for example, from the German patent No. 37 10 677. From the expansion device the expanded stems are supplied to a separator which separates the fluid used for expanding. For this purpose the separator as set forth in European patent No. 0 301 217 may be employed.

These expanded stems then reach the blending bin so that the lamina material, on the one hand, and the expanded stems, on the other, are subjected to the steps in the process as already described above.

Figure 3:
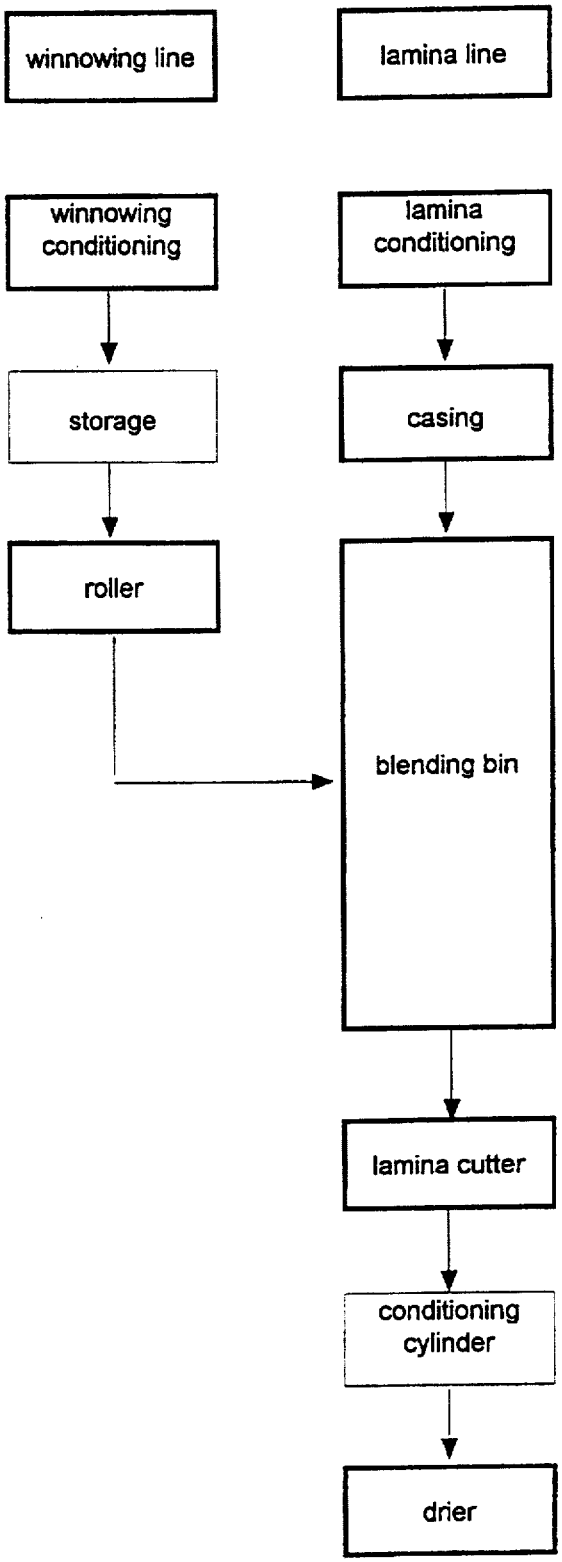
FIG. 3 shows a second embodiment of a plant for producing cut tobacco for cigarettes from winnowings and lamina.

In the case of the plant shown in FIG. 3 a winnowing line is provided parallel to the lamina line which has the same configuration as the lamina line as shown in FIGS. 1 and 2, this winnowing line receiving the winnowings resulting in the course of tobacco preparation. The winnowings are conditioned in a steam tunnel which operates with water and steam so that the winnowings leave the conditioning with a moisture content of approximately 30% to 35%.

The conditioned winnowings are held covered for roughly 2 hours and are then rolled with a roller having a gap width or nip of approximately 0 mm.

The rolled and conditioned winnowings are then supplied via a charging chute to the blending bin which also receives the preconditioned and cased lamina material. The conditioning requirements correspond to those of the embodiment in FIGS. 1 and 2.

The blend of winnowings and lamina material leaving the blending bin is further processed in the same way as already described above for the blend of stems and lamina, i.e. cut, preheated and finally dried.

Figure 4:
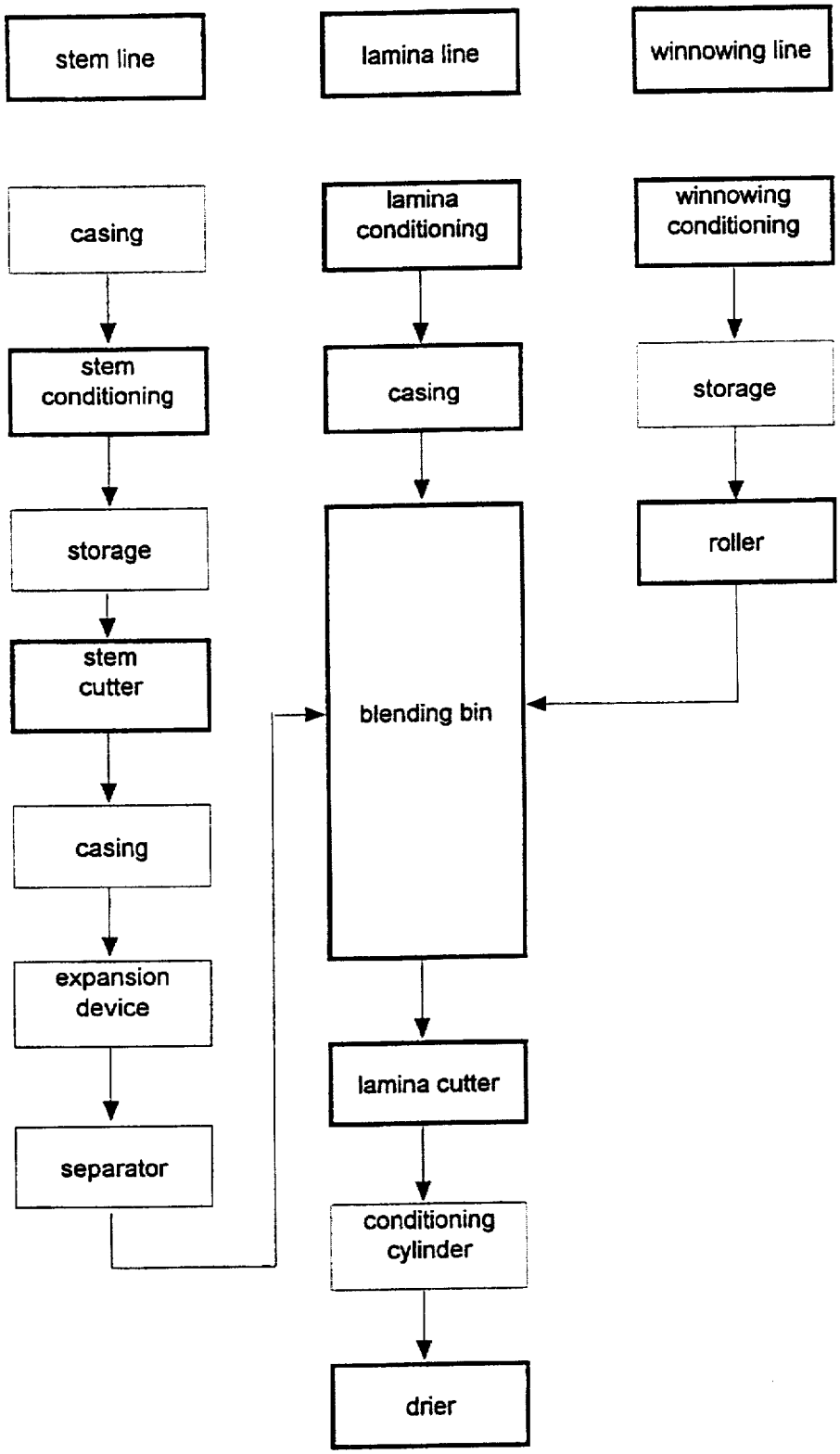
FIG. 4 shows a third embodiment of a plant for producing cut tobacco for cigarettes from stems, lamina and winnowings.

Finally FIG. 4 shows an embodiment in which the two embodiments shown in FIGS. 2 and 3 are combined, i.e. the blending bin receives the conditioned, precut and cased stems, the conditioned, cased lamina material as well as the conditioned and rolled winnowings. This blend is then cut, preheated and finally dried.

For the plants as shown in FIGS. 3 and 4 the same operating conditions apply as already explained above.

Also possible is the modification as shown in FIG. 1, i.e. without expansion of the stems.

We claim:

1. A method of treating tobacco leaves for the production of cut tobacco for smokable articles, wherein a) non-rolled stems are conditioned and precut separately from the lamina material, b) lamina material is conditioned separately from the stems, c) stems and lamina material are subsequently blended and then d) lamina material and stems are cut and dried jointly.

2. The method as set forth in claim 1, wherein at least one of said stems and said lamina materials is provided with a casing.

3. The method as set forth in claim 2, wherein said stems are provided with casing after precutting.

4. The method as set forth in claim 3, wherein said lamina material is provided with casing after conditioning.

5. The method as set forth in claim 1, wherein said stems, prior to precutting, are conditioned to a moisture content of approximately 22% to approximately 26%.

6. The method as set forth in claim 1, wherein said conditioned stems, prior to precutting, are stored for at least 1.5 hours in a closed environment.

7. The method as set forth in claim 1, wherein the stems are precut to a cutting width of approximately 0.1 to approximately 0.3 mm.

8. The method as set forth in claim 7, wherein said precut stems are expanded.

9. The method as set forth in claim 1, wherein for cigarette production the lamina material is conditioned to a moisture content of approximately 17 to approximately 25%, whilst for fine-cut production the lamina material is conditioned to a moisture content of approximately 23 to approximately 25%.

10. The method as set forth in claim 1, wherein max. 30% precut stems relative to the quantity as a whole are added to said lamina material.

11. The method as set forth in claim 1, wherein for cigarette production the lamina material and stems are cut with a cutting width of approximately 0.5 to 2 mm, whilst for fine-cut production lamina material and stems are cut with a cutting width of approximately 0.35 mm to approximately 0.5 mm.

12. The method as set forth in claim 1, wherein said lamina material and said stems, after cutting, are brought to a moisture content of approximately 18 to 39%, and then dried to a moisture content of approximately 13 to approximately 16%.

13. A plant for the treatment of tobacco leaves for the production of cut tobacco for smokable articles, comprising:

a) a conditioning means for the stems of the tobacco leaves separated from the lamina material, b) a conditioning means for the lamina material of the tobacco leaves, c) a precutting means for the stems, d) a cutting means for a blend of said conditioned, non-rolled, precut stems and said conditioned and uncut lamina material, and f) at least one drier for said cut blend of lamina material and stems.

14. The plant as set forth in claim 13, comprising a blending bin for said conditioned and uncut lamina material to which said conditioned, non-rolled, precut stems are fed.

15. The plant as set forth in claim 13, wherein a saucing means for casing said stems and/or said lamina material is provided, said saucing means for said stems being included upstream of said means for conditioning said stems or downstream of said stem cutting means, whilst said saucing means for said lamina material is disposed between said conditioning means for said lamina material and said blending bin.

16. The plant as set forth in claim 13, comprising a preheating and conditioning means for said cut blend of lamina material and stems.

17. The plant as set forth in claim 16, wherein downstream of said preheating means a drier is disposed.

18. The plant as set forth in claim 13, wherein an expansion device for said stems is provided which is disposed between said cutting means for said stems and said blending bin for said lamina material and said stems.

19. A method of treating tobacco leaves for the production of cut tobacco for smokable articles, wherein a) winnowings are conditioned and rolled separately from lamina material, b) lamina material is conditioned separately from said winnowings, c) the rolled winnowings and said lamina material are subsequently blended, and d) lamina material and winnowings are cut and dried jointly.

20. The method as set forth in claim 19, wherein said conditioned winnowings are rolled with a gap width of less than 0.1 mm.

21. The method as set forth in claim 20, wherein said winnowings are rolled with a gap width of approximately 0 mm.

22. The method as set forth in any of the claims 19, wherein said rolled winnowings have a moisture content of approximately 25% to approximately 40%.

23. The method as set forth in in claim 13, wherein conditional, non-rolled and pre-cut stems are blended with said lamina material and said winnowings.

24. A plant for the treatment of tobacco leaves for the production of cut tobacco for smokable articles, comprising a) a conditioning means for winnowings, b) a rolling means for said conditioned winnowings, c) a conditioning means for the lamina material of said tobacco leaves, d) a cutting means for a blend of said conditioned, rolled winnowings and said conditioned and uncut lamina material, and e) at least one drier for said cut blend of lamina material and winnowings.

25. A plant as set forth in claim 24, wherein conditioned, non-rolled and precut stems are mixed with said blend.

* * * * *